US006984174B2

(12) United States Patent
Cannon et al.

(10) Patent No.: US 6,984,174 B2
(45) Date of Patent: Jan. 10, 2006

(54) METHOD AND APPARATUS FOR A PLAYER-CONTROLLABLE BONUS GAME

(75) Inventors: Lee E. Cannon, Bozeman, MT (US); Julie A. Mottes, Henderson, NV (US); Brian A. Johnson, Las Vegas, NV (US); Michael L. White, Las Vegas, NV (US)

(73) Assignee: IGT, Reno, NV (US)

( * ) Notice: Subject to any disclaimer, the term of this patent is extended or adjusted under 35 U.S.C. 154(b) by 217 days.

(21) Appl. No.: 10/029,379

(22) Filed: Dec. 20, 2001

(65) Prior Publication Data

US 2003/0119581 A1 Jun. 26, 2003

(51) Int. Cl.
*A63F 9/24* (2006.01)

(52) U.S. Cl. ..... 463/25; 463/42; 340/323 R

(58) Field of Classification Search ..... 463/9–13, 463/16–20, 25–30, 36–42, 43; 273/236–237, 273/118 R, 121 B, 292–293, 143 R, 148 R, 273/138.1, 148 B, 138.2, 139; 340/323 R; 700/91–93

See application file for complete search history.

(56) References Cited

U.S. PATENT DOCUMENTS

| | | | |
|---|---|---|---|
| 3,281,149 | A | 10/1966 | Miller |
| 4,695,053 | A | 9/1987 | Vazquez, Jr. et al. |
| 4,700,948 | A | 10/1987 | Okada |
| 4,743,024 | A | 5/1988 | Helm et al. |
| 4,775,155 | A | 10/1988 | Lees |
| 4,805,907 | A | 2/1989 | Hagiwara |
| 4,836,546 | A | 6/1989 | DiRe et al. |
| 4,856,787 | A | 8/1989 | Itkis |
| 4,871,171 | A | 10/1989 | Rivero |
| 4,906,005 | A | 3/1990 | Manabe |
| 5,167,413 | A | 12/1992 | Fulton |
| 5,205,555 | A | 4/1993 | Hamano |
| 5,242,163 | A | 9/1993 | Fulton |
| 5,259,616 | A | 11/1993 | Bergmann |
| 5,299,810 | A | 4/1994 | Pierce et al. |
| 5,342,049 | A | 8/1994 | Wichinsky et al. |
| 5,344,145 | A | 9/1994 | Chadwick et al. |
| 5,393,057 | A | 2/1995 | Marnell, II |

(Continued)

FOREIGN PATENT DOCUMENTS

| | | |
|---|---|---|
| DE | 2938307 | 4/1981 |

(Continued)

OTHER PUBLICATIONS

Geddes, Ribert N., "Slot Machines on Parade," Oct. 1980, p. 128.

(Continued)

*Primary Examiner*—Mark Sager
(74) *Attorney, Agent, or Firm*—Marshall, Gerstein & Borun LLP

(57) ABSTRACT

Gaming systems and methods where qualification for play of a bonus game is linked to play of a base game. Multiple players may qualify for the bonus game by achieving preselected criteria associated with play of the base game. The qualified players may participate in the bonus game and achieve a bonus game outcome based on the player's skill or strategy. The bonus game outcome may allow the player to accumulate bonus awards. In addition, the bonus game outcome may impede or terminate the player's movement in the bonus game. Each player's movement in the bonus game may depend on his or her continued play in the base game. Each qualified player may also eliminate other qualified players by occupying the same space in the bonus game.

53 Claims, 6 Drawing Sheets

U.S. PATENT DOCUMENTS

| | | | |
|---|---|---|---|
| 5,411,271 | A | 5/1995 | Mirando |
| 5,486,005 | A | 1/1996 | Neal |
| 5,511,781 | A | 4/1996 | Wood et al. |
| 5,536,016 | A | 7/1996 | Thompson |
| 5,560,603 | A | 10/1996 | Seelig et al. |
| 5,609,337 | A | 3/1997 | Clapper, Jr. |
| 5,611,730 | A | 3/1997 | Weiss |
| 5,628,684 | A | 5/1997 | Bouedec |
| 5,630,753 | A | 5/1997 | Fuchs |
| 5,639,089 | A | 6/1997 | Matsumoto et al. |
| 5,641,730 | A | 6/1997 | Brown |
| 5,645,486 | A | 7/1997 | Nagao et al. |
| 5,647,798 | A | 7/1997 | Falciglia |
| 5,664,998 | A | 9/1997 | Seelig et al. |
| 5,695,402 | A | 12/1997 | Stupak |
| 5,707,285 | A | 1/1998 | Place et al. |
| 5,722,891 | A | 3/1998 | Inoue |
| 5,755,619 | A | 5/1998 | Matsumoto et al. |
| 5,772,509 | A | 6/1998 | Weiss |
| 5,779,544 | A | 7/1998 | Seelig et al. |
| 5,788,573 | A | 8/1998 | Baerlocher et al. |
| 5,823,874 | A | 10/1998 | Adams |
| 5,833,537 | A | 11/1998 | Barrie |
| 5,848,932 | A | 12/1998 | Adams |
| 5,851,148 | A | 12/1998 | Brune et al. |
| 5,876,284 | A | 3/1999 | Acres et al. |
| 5,882,261 | A | 3/1999 | Adams |
| 5,911,418 | A | 6/1999 | Adams |
| 5,927,714 | A | 7/1999 | Kaplan |
| 5,935,002 | A | 8/1999 | Falciglia |
| 5,947,820 | A | 9/1999 | Morro et al. |
| 5,980,384 | A | 11/1999 | Barrie |
| 5,993,315 | A | 11/1999 | Strider et al. |
| 5,997,401 | A | 12/1999 | Crawford |
| 6,012,982 | A | 1/2000 | Piechowiak et al. |
| 6,019,369 | A | 2/2000 | Nakagawa et al. |
| 6,050,895 | A | 4/2000 | Luciano, Jr. et al. |
| 6,059,658 | A | 5/2000 | Mangano et al. |
| 6,089,976 | A | 7/2000 | Schneider et al. |
| 6,089,978 | A | 7/2000 | Adams |
| 6,093,102 | A | 7/2000 | Bennett |
| 6,120,377 | A | 9/2000 | McGinnis, Sr. et al. |
| 6,126,542 | A | 10/2000 | Fier |
| 6,135,884 | A | 10/2000 | Hedrick et al. |
| 6,146,273 | A | 11/2000 | Olsen |
| 6,186,894 | B1 | 2/2001 | Mayeroff |
| 6,190,255 | B1 | 2/2001 | Thomas et al. |
| 6,203,429 | B1 | 3/2001 | Demar et al. |
| 6,210,275 | B1 | 4/2001 | Olsen |
| 6,224,482 | B1 | 5/2001 | Bennett |
| 6,224,483 | B1 | 5/2001 | Mayeroff |
| 6,231,442 | B1 | 5/2001 | Mayeroff |
| 6,290,600 | B1 | 9/2001 | Glasson |
| 6,302,790 | B1 | 10/2001 | Brossard |
| 6,315,660 | B1 | 11/2001 | DeMar et al. |
| 6,338,678 | B1 | 1/2002 | Seelig et al. |
| 6,386,974 | B1 | 5/2002 | Adams |
| 6,461,241 | B1 | 10/2002 | Webb et al. |
| 6,722,976 | B2 | 4/2004 | Adams |
| 2002/0016200 | A1 | 2/2002 | Baerlocher et al. |
| 2002/0128055 | A1 | 9/2002 | Adams |
| 2003/0127793 | A1 | 7/2003 | Adams |

FOREIGN PATENT DOCUMENTS

| | | | |
|---|---|---|---|
| DE | 3700861 | | 7/1988 |
| DE | 4014477 | | 7/1991 |
| EP | 0333338 | | 9/1989 |
| EP | 0449433 | | 3/1990 |
| EP | 0464935 | | 1/1992 |
| GB | 1242298 | | 8/1971 |
| GB | 2066991 | | 7/1981 |
| GB | 2072395 | | 9/1981 |
| GB | 2083936 | | 3/1982 |
| GB | 2084371 | | 4/1982 |
| GB | 2096376 | | 10/1982 |
| GB | 2137392 | | 10/1984 |
| GB | 2153572 | | 8/1985 |
| GB | 002161008 A | * | 1/1986 |
| GB | 2170938 | | 8/1986 |
| GB | 2182186 | | 5/1987 |
| GB | 2191030 | | 12/1987 |
| GB | 2201821 | | 9/1988 |
| GB | 2202984 | | 10/1988 |
| GB | 2226436 | | 6/1990 |
| GB | 2242300 | | 9/1991 |
| JP | 5131044 | | 5/1993 |
| WO | WO 98/51384 | | 11/1998 |
| WO | WO 00/12186 | | 3/2000 |

OTHER PUBLICATIONS

Advertisement, Bally Distributing Company, Double or Nothing, Model 1083, Ch. 11, 1975-1984, p. 267.
Fey, Marshall, "Slot Machines," 1983, p. 126, 150.
Intergame Magazine, Jun. 1995, cover and pp. 91, 101.
Bingo Game Brochure published by Casino Data Systems in 1998.
Full House Brochure published by Anchor Games in 2000.
Match Reel Game Bonus Description published by IGT.
Jewel in the Crown Brochure published by Barcrest, Ltd.
Jewel in the Crown Brochure published by IGT in 1999.
Jackpot Bingo published by CDS.com printed on Apr. 12, 2001.
Bueschel, Richard M., "An Illustrated Price Guide to the 100 Most Collectible Trade Stimulators," 1978, pp. 21, 29, 83.
Bueschel, Richard M., "Slots 1," 1978, pp. 136, 142.

* cited by examiner

METHOD AND APPARATUS FOR A PLAYER-CONTROLLABLE BONUS GAME

BACKGROUND OF THE INVENTION

1. Field of the Invention

The present invention relates generally to gaming systems and methods. More specifically, the present invention relates to gaming systems and methods wherein a player is able to interact with other players in a bonus game based upon strategy or skill.

2. State of the Art

Various mechanical and electronic gaming systems and their associated apparatus and methods of use are well known in the gaming industry. Slot machines have long been a significant part of the gaming industry and, now, video versions of slot machines are very popular. However, the chief drawback of traditional gaming machines, such as slot machines, is the minimal participation a player has in the outcome of the game. The player merely initiates play of the gaming machine and the gaming machine randomly selects the outcome. With this lack of participation, some players may quickly become bored with the games, even if the players have been highly successful at such games.

Gaming establishments are continually searching for new games and gaming systems to keep the interest of players because even successful games become tiresome if they have been heavily played. Gaming establishments such as casinos are concerned that if players lose interest in a game, the gaming machine will sit idle and not contribute to the revenue of the casino. By developing new games, the gaming establishments hope to stimulate existing players' interests in continued wagering, as well as to attract new players. In addition, since players tend to be more active and consistent in playing gaming machines that have new games, the potential profit of the gaming machine is enhanced.

To keep and increase players' interest in gaming, the gaming industry has added "bonus games" to many of its base or primary games. These base games include reel and electronic slot machines. A bonus game is a secondary game that is typically activated when the player achieves a specific outcome in the base game. For instance, the bonus game may be activated when the player receives a winning hand (in the case of a card game) or a specified combination of symbols (in the case of a reel-type game) as an outcome of the base game being played. Bonus games appeal to players because the probability of receiving winning combinations after entry into the bonus game is, at least, greatly enhanced and, in most instances, some sort of winning outcome is guaranteed.

Bonus games also allow the player to multiply his or her winnings in the base slot machine game or allow the player to win a bonus prize. The bonus game is typically a different type of game than the base game, which provides more excitement and variety for the player and helps to keep the player at the gaming machine for a longer period of time. However, the bonus game may also be the same type of game as the base game, except that the bonus game has an increased potential for winning in comparison to the base game. However, the outcomes in the bonus games are dictated by chance and so the bonus games suffer from the same fundamental flaws as the base game.

The bonus games developed to date fall into multiple categories. Some bonus games are included on unlinked, stand-alone gaming machines. Others are included on linked, or networked, gaming machines that communicate through a central controller to allow players to enter the bonus game. Yet other bonus games include a singular event in that the play changes to the bonus game when a specific outcome is achieved in the base game. However, in yet other bonus games, play is a more sequential event in that progressing through the bonus game is determined by continued play in the base game.

One example of a bonus game played on an unlinked, stand-alone slot machine is described in U.S. Pat. No. 6,186,894 to Mayeroff. In this bonus game, the base game is a multi-reel, multi-pay line slot machine and the bonus game is a slot machine with at least one reel and at least one pay line. A second example is described in U.S. Pat. No. 6,190,255 to Thomas. This bonus game includes a grid of symbols, each of which is associated with a bonus game outcome. A player chooses symbols until he receives an end-bonus outcome symbol. The player then receives the values of the symbols that were chosen before the end-bonus outcome was achieved. A similar bonus feature is described in U.S. Pat. No. 6,203,429 to Demar, in which a player accumulates bonus awards in the bonus game until a losing combination occurs.

In many cases, bonus games include a singular event in that the play changes to the bonus game when the specific outcome is achieved in the base game. The bonus game is then played to completion. Examples of these types of bonus game are disclosed in U.S. Pat. Nos. 5,823,874, 5,848,932, 5,882,261 and 6,089,978, all to Adams. Various embodiments of these patents include methods of playing games that employ gaming machines, as well as table games, to play base games and at least one payout indicator for a secondary or bonus game. The bonus game is independent of the base game but is enabled by selected outcomes in the base game. In one embodiment, the bonus game is enabled when the reels of the base game produce a preselected outcome. The player initiates a spin of a wheel or reel bearing a number of payout values, or initiates another bonus event such as a bowling-type or pinball-type payout indicator. When the bonus event is complete, the amount of the bonus payout is indicated by the wheel or other payout indicator.

Another example of this type of bonus game is described in U.S. Pat. No. 6,089,976 to Schneider et al. In this design, the bonus game displays multiple images on a video monitor. The player selects from these images until he or she achieves a pair of matched bonus awards. The amount of the bonus award is paid out to a credit meter or directly to the player.

In the bonus games described above, play in the bonus game is independent of play in the base game. In addition, these bonus games require no appreciable skill because there is no way for a player to alter the course of the game or otherwise form a strategy to play the game. The player is merely a passive observer. Further, players do not interact to provide a competitive environment.

In some bonus games, play of the game is a more sequential event in that progressing through the bonus game is determined by continued play in the base game. An example of this is described in U.S. Pat. No. 5,980,384 to Barrie. In this design, the player may win the base game on each play of the game. In addition, outcomes in the base game may create secondary symbols and change player options in the bonus game. The player may exercise a level of skill in deciding whether to allow the creation of the secondary symbols in order to win the bonus game. The bonus game may be won over a plurality of plays of the base game.

The bonus game may also be conducted through a plurality of networked games so that the bonus game might be played by a plurality of players who have been wagering at the base games. Some examples of networked bonus gaming include U.S. Pat. No. 5,779,544, U.S. Pat. No. 5,664,998 and U.S. Pat. No. 5,560,603, all to Seelig et al., which disclose a racing game linked to a standard slot machine. The racing elements are moved around the racetrack based on play of the base game. Other patents that disclose a plurality of networked base gaming machines include U.S. Pat. No. 6,146,273 to Olsen, U.S. Pat. No. 6,012,982 to Piechowiak et al., and U.S. Pat. No. 5,876,284 to Acres et al.

Another similar patent is U.S. Pat. No. 6,210,275 to Olsen. This bonus game is a variation of a racetrack game. Each player that qualifies for the bonus game is delivered a ticket that lists the horses in the race. The race is run and the controller determines whether any of the qualified players has won the race. If no player wins the race, subsequent rounds are run with each round comprising one less horse than the previous round. Since there are fewer horses in subsequent rounds, the players who remain in the game have a higher chance of winning the bonus game. The winner of each round is randomly selected.

In the above-mentioned bonus games, the player's odds of winning are based purely on chance because the games are configured so that the player has no opportunity to use skill or strategy to improve his or her odds. Stated another way, the player has no direct control over the outcome of these bonus games. Rather, the player's odds of winning are based on a random number generator that selects the outcome of the game. Games based on skill are not commonly used in the gaming industry because gaming establishments cannot accurately factor the player's level of skill into the net-return of the gaming machines. Examples of games that may require skill include strategy games (i.e., chess, checkers, or bridge), puzzles (i.e., mazes, crosswords, or jigsaws), dexterity games requiring hand-eye coordination (i.e., flight simulators or sports games), or knowledge games (i.e., trivia games).

In addition, there is no player interaction in these bonus games. The player does not interact with other players in the above-mentioned bonus games because these games are played against the house or against the gaming machine. Even in the bonus games that display races, the player merely observes his position relative to other players. The player in the bonus game, as in the nonlinked games, is in a passive, non-thinking environment.

While numerous bonus games have been used in the gaming industry, improved gaming systems and methods are still needed to stimulate and maintain players' interests in gaming. Preferably, these improved gaming systems and methods would appeal to the player's competitive nature, allow the player to control the outcome in the bonus game, and allow the player to interact with other players in the bonus game. Such a bonus game would increase the player's level of excitement by placing players in a competitive setting and would appeal to those players who want more control over the outcome in the bonus game. Therefore, what is needed is a new game that allows players to develop and execute a strategy for defeating other players in a competitive contest. Such a game would allow players to be rewarded for good game play and penalized for poor game play. Such a game should allow a player to control his or her game play by moving his or her marker relative to other players, bonus awards, and hazards.

BRIEF SUMMARY OF THE INVENTION

The present invention relates to gaming systems and methods of conducting games of chance that may be employed on multiple, linked or networked gaming machines. The gaming machines may be networked to enable play of a bonus game in a competitive setting. In one embodiment, a method of conducting a game of chance is disclosed. The game of chance includes a base game and a bonus game. The method includes enabling a plurality of players to play the bonus game. Each player of the plurality may compete against the other enabled players and may, optionally eliminate at least one player of the remaining players.

In a more specific implementation, the method includes enabling the bonus game to be played when at least one player achieves a specific outcome or otherwise qualifies by meeting preselected criteria during play of the base game, which may comprise a reel-type slot machine game or other conventional game of chance. After the at least one player has qualified for the bonus game, the player navigates around a bonus game "field" to accumulate bonus awards while avoiding game outcomes that may exit the player from the game. The player may also be eliminated from the bonus game if another player occupies the same space on the bonus game field. The player's movement in the bonus game field is based on continued play in the base game.

A system for conducting a game of chance is also provided. The system includes a plurality of gaming machines, each configured to play a base game and networked to play a bonus game. The bonus game is configured to enable qualified players to use strategy or skill to achieve a bonus game outcome. The bonus game is further configured so that qualified players may compete against one another and have the opportunity to eliminate other qualified players from the bonus game.

DESCRIPTION OF THE DRAWINGS

By way of example, particular embodiments of the invention will be described with reference to the accompanying drawings, in which like parts have the same index numerals in which.

DETAILED DESCRIPTION OF THE INVENTION

The present invention relates to gaming systems and methods where a bonus game is linked to play of a base game. The bonus game includes a bonus game field through which a player navigates in an attempt to obtain and accumulate bonus awards. The player qualifies for the bonus game by achieving a specific outcome in the base game or through other criteria associated with play of the base game. Qualifying for the bonus game enables the player to compete against other players in the bonus game, with the outcome of the bonus game based on each player's level of skill or strategy. The bonus game may be simultaneously played by multiple players, which allows the players to compete against one another to accumulate the bonus awards. In addition, competition may be enhanced by allowing the players to eliminate each other from the bonus game.

Figure 1:
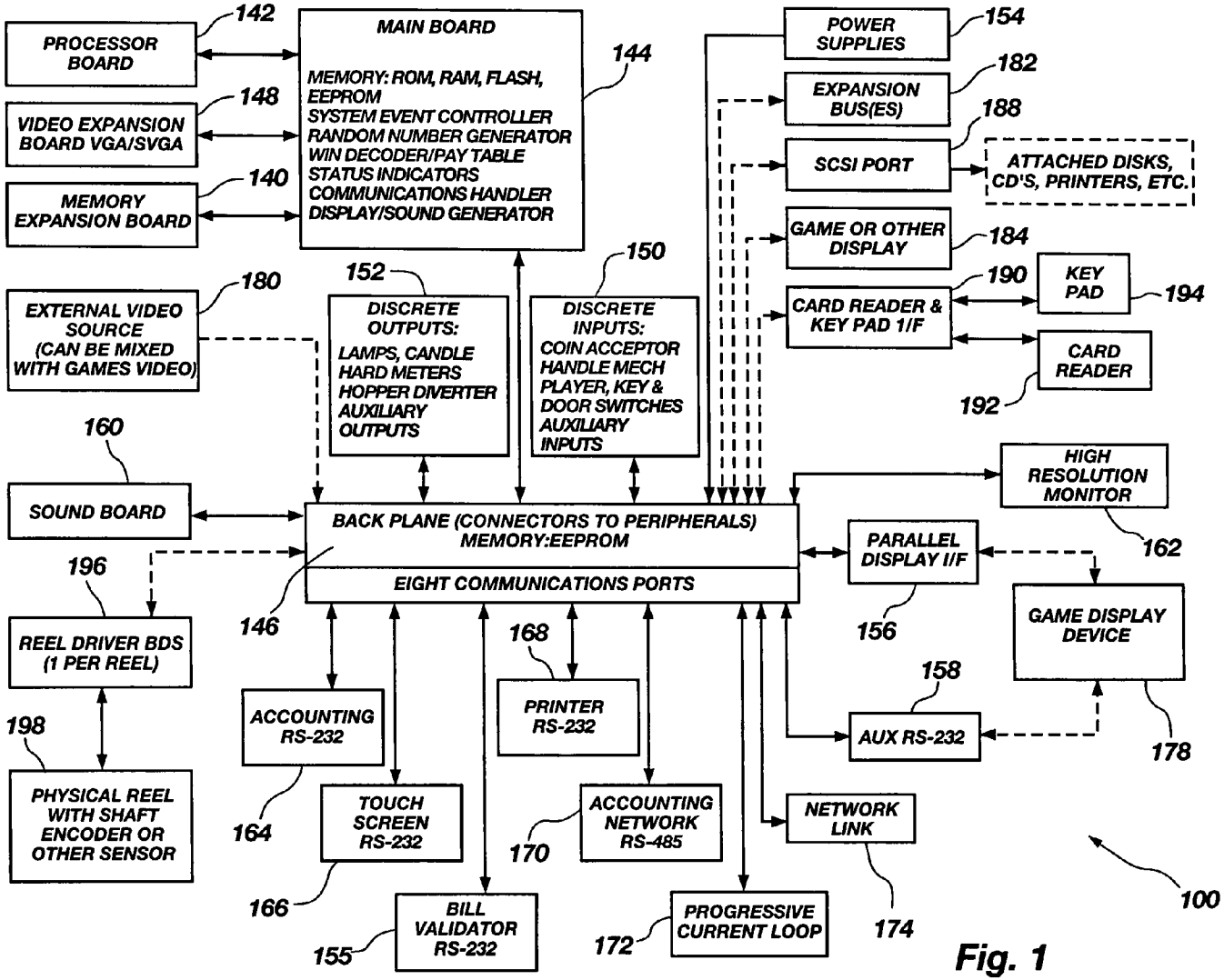
FIG. 1 shows an exemplary gaming machine according to the present invention.

Referring to FIG. 1, gaming machine or device 100 includes a memory expansion board 140, a processor board 142, a main board 144 and a back plane 146 integrally or separately formed. The processor board 142 includes a video expansion board VGA/SVGA 148 that is operatively coupled to the main board 144. The main board 144 preferably includes memory in the form of ROM, RAM, flash memory and EEPROM (electrically erasable programmable read only memory). In addition, the main board 144 includes a system event controller, a random number generator, a win decoder/pay table, status indicators, a communications handler and a display/sound generator.

The main board 144 is operatively coupled to the back plane 146 which may include additional memory, such as in the form of an EEPROM and connectors to connect to peripherals. Furthermore, the back plane 146 provides a plurality of communication ports for communicating with external peripherals. The back plane 146 provides the coupling between discrete inputs 150 and the processor board 142 and main board 144. Typical examples of elements, which provide discrete inputs 150 are coin acceptors, game buttons, mechanical hand levers, key and door switches and other auxiliary inputs. Furthermore, the back plane 146 provides the coupling between discrete outputs 152 and the processor board 142 and main board 144. Typically, elements that provide discrete outputs 152 are in the form of lamps, hard meters, hoppers, diverters and other auxiliary outputs.

The back plane 146 also provides connectors for at least one power supply 154 for supplying power for the processor and a parallel display interface ("PDI") 156 and a serial interface 158 for operably coupling to game display device 178. In addition, the back plane 146 also provides connectors for a soundboard 160 and a high-resolution monitor 162. Furthermore, the back plane 146 includes communication ports for operatively coupling and communicating with an accounting link 164, a touch screen 166, a bill validator 155 incorporated in a currency acceptor, a printer 168, an accounting network link 170, a progressive current loop 172 and a network link 174.

The back plane 146 optionally includes connectors for external video sources 180, expansion buses 182, game or other display means 184, an SCSI port 188 and an interface 190 for operably coupling to the card reader 192 and key pad 194. The back plane 146 also preferably includes means for coupling a plurality of reel driver boards 196 which drive physical game reels 198 with a shaft encoder or other sensor means to the processor board 142 and main board 144. In addition, the reels may be similarly implemented electronically by display as video images, technology for such an approach being well known and widely employed in the art. In such an instance, reel driver boards 196 and physical game reels 198 (with associated hardware) are eliminated and the game outcome generated by the random number generator is directly displayed on a high resolution monitor 162 and, optionally, on game display device 178, as known in the art. Other gaming machine configurations for play of different wagering games such as video poker games, video blackjack games, video Keno, video bingo, or any other suitable base games are equally well known in the art. It will also be understood and appreciated by those of ordinary skill in the art that selected components of gaming device 100 may be duplicated for play of a base game linked to a bonus game in accordance with the present invention, in that at least a separate board may be employed, with associated peripherals and links thereto, for play of the bonus game. In the conventional situation wherein the bonus game of the present invention may be operably coupled as a "top box" or otherwise associated with a conventional, existing gaming machine 100 configured for play of the base game, many of the components illustrated in FIG. 1 and described with respect thereto will be duplicated, including separate software and associated memory for conducting play of the bonus game with associated pay tables for the bonus awards.

Gaming machine 100 may be used to play the base game that activates or triggers the bonus game of the present invention and as a terminal for play of the bonus game. This gaming machine 100 may be configured as a reel-type gaming machine, a video gaming machine that simulates reels or enables play of a card game, or any other type of mechanical or electronic gaming device known in the art. For instance, the base game may be a conventional casino gaming machine, such as a slot machine, with a monetary exchanger for accepting wagers and making award payouts.

Figure 2:
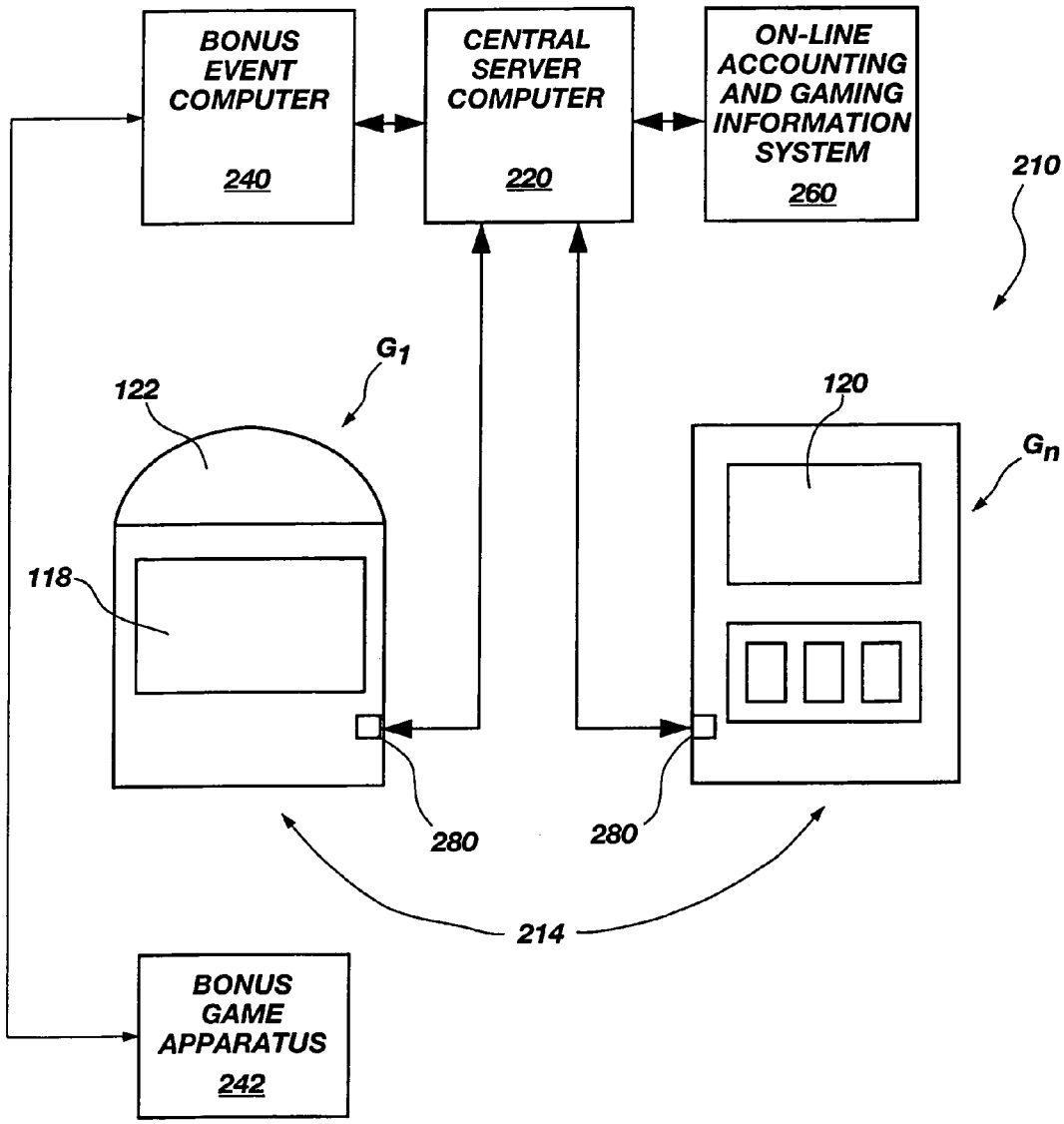
FIG. 2 is a diagrammatic representation of a competitive bonus gaming network according to the present invention.

In one embodiment of the present invention, multiple gaming machines 100 located at a particular casino site comprise a bank 214 or other plurality of gaming machines $G_1, G_2 \ldots G_n$, which may be configured, by way of example only, as gaming machines 100. In implementation of the present invention, the gaming machines $G_1, G_2 \ldots G_n$ offering play of the bonus game of the present invention may be deployed, as schematically depicted in FIG. 2, in a gaming network 210 including a central server computer 220 operably coupled to a bank 214 of gaming machines $G_1, G_2 \ldots G_n$, which may include both electronic and reel-type game machines. It is notable that, unless the gaming network 210 is configured for progressive play, a variety of different makes of gaming machines $G_1, G_2 \ldots G_n$ offering widely different games may be incorporated in gaming network 210, since the bonus game operates independently of the base game on each gaming machine 100. The central server computer 220 automatically interacts with a plurality of gaming machines $G_1, G_2 \ldots G_n$ to activate the bonus game.

More specifically, and again referring to FIGS. 1 and 2, the gaming network 210 includes a central server computer 220, a bonus event computer 240, and a plurality of gaming machines $G_1, G_2 \ldots G_n$. Each gaming machine $G_1, G_2 \ldots G_n$ includes a bonus game controller or controller assembly 280 operably coupled to the central server computer 220 and comprised of a controller unit designed to facilitate transmission of signals from each individual gaming machine $G_1, G_2 \ldots G_n$. In addition, the bonus game controller 280 includes a network interface board fitted with appropriate electronics for each specific make and model of each individual gaming machine $G_1, G_2 \ldots G_n$.

Referring to FIG. 2, in electronic video games, the central server computer 220 is operably coupled to at least one video game display element 118, as shown on the left hand side of FIG. 2, and sequesters a portion of the video game display element 118 for displaying video attract sequences to attract potential players. Video game display element 118 may be used for display of both the base and bonus games. Where the gaming network 210 includes reel-type game machines $G_1, G_2 \ldots G_n$, as shown on the right hand side of FIG. 2, the central server computer 220 may be operably coupled to at least one active display element 120 so that potential players receive a clear indication of attract sequences and the active display element may be used as a video display for the bonus game. As shown on the left hand side of FIG. 2, the gaming machines $G_1, G_2 \ldots G_n$ may also be provided with a second video display element 122 as an alternative to sequestering a portion of the video game display element 118 for displaying video attract sequences and the bonus game. In addition, the central server computer 220 may include sound generating hardware and software for producing attractive sounds orchestrated with the video attract sequences at each of gaming machines $G_1, G_2 \ldots G_n$ if such is not already incorporated therein. The games support input and output between the player and the game for devices such as a heads-up display, a joystick, a keyboard, a mouse, and a data glove via interface modules connected through the expansion bus or buses 182 and SCSI port 188.

The attractive multimedia video displays and dynamic sounds may be provided by the central server computer 220 by using multimedia extensions to allow gaming machines $G_1, G_2 \ldots G_n$ to display full-motion video animation with sound to attract players to the machines. During idle periods, the gaming machines $G_1, G_2 \ldots G_n$ preferably display a sequence of attraction messages in sight and sound. The videos may also be used to market specific areas of the casino and may be customized to any informational needs.

Furthermore, the gaming network 210 includes bonus event computer 240 operably coupled to the central server computer 220 for scheduling bonus parameters such as the type of bonus game, pay tables, and players. The bonus game computer 240 may include various types of bonus games that are stored on the bonus game computer 240. Of course, the functions of central server computer 220 and bonus game computer 240 may be implemented on a single computer.

The bonus game may be conducted solely on the bonus event computer 240 and visible manifestations of the bonus game, including any game outcomes thereof, are displayed as video images on high resolution monitor 162, game display device 178, or bonus game display 236. Alternatively, a separate bonus game apparatus 242 for providing an actual, physical implementation of the bonus game, such as a live maze or treasure hunt, may be operably coupled to bonus event computer 240. Bonus event computer 240 may be employed to initiate the bonus game on bonus game apparatus 242 and to receive communications indicative of the course of the bonus game and any game outcomes for determination of winners and losers and issuance of bonus awards resulting from winning wagers. Preferably, the gaming network 210 further includes a real-time or on-line accounting and gaming information system 260 operably coupled to the central server computer 220. The accounting and gaming information system 260 includes a player database for storing player profiles, a player tracking module for tracking players, and a pit cage and credit system for providing automated casino transactions.

As previously implied, a bank 214 of gaming machines $G_1, G_2 \ldots G_n$ may be networked together in a progressive configuration, as known in the art, wherein a portion of each wager used to initiate the base game may be allocated to awards in the bonus game. In addition, and referring to FIG. 3, a host site computer 320 is coupled to a plurality of the central server computers 220 at a variety of remote gaming sites $C_1, C_2 \ldots C_n$ for providing a multi-site linked automated bonus gaming system 310 which, optionally, may be configured for progressive play.

Preferably, the host site computer 320 will be maintained for the overall operation and control of the bonus gaming system 310. The host site computer 320 includes a host site computer network 322 and a communication link 324 provided with a high-speed, secure modem link for each individual casino site $C_1, C_2 \ldots C_n$.

Each casino site $C_1, C_2 \ldots C_n$, includes the central server computer 220 provided with a network controller 230 that includes a high-speed modem operably coupled thereto. Bi-directional communication between the host site computer 320 and each casino site central server 220 is accomplished by the set of modems transferring data over communication link 324.

A network controller 230, a bank controller 232, and a communication link 234 are interposed between each central server 220 and the plurality of attached gaming machines $G_1, G_2 \ldots G_n$ at each casino site $C_1, C_2 \ldots C_n$. In addition, the network controller 230, the bank controller 232, and the communication link 234 may optionally be interposed between each central server computer 220 and bonus game display 236 at each casino site $C_1, C_2 \ldots C_n$. However, the system 310 may include hardware and software to loop back data for in-machine meter displays to communicate with bonus event award insert areas on gaming machines $G_1, G_2 \ldots G_n$.

By way of exemplary implementation of the present invention, the bank 214 of gaming machines $G_1, G_2 \ldots G_n$ may be connected or linked to form a competitive bonus gaming network 210. The bank 214 of gaming machines $G_1, G_2 \ldots G_1$, may also be connected or linked to the bonus game display 236. The bank 214 of gaming machines is represented in FIG. 2 as $G_1$ through $G_n$, where $G_1$ is depicted as an electronic slot machine and $G_n$ is depicted as a reel-type slot machine. Although two, networked gaming machines are illustrated in FIG. 2, it will be readily apparent to one of ordinary skill in the art that any number of gaming machines $G_1, G_2 \ldots G_n$ may be used in the present invention.

Bonus game display 236 may be configured as a relatively large, liquid crystal display ("LCD") screen or a plurality of such screens. The screen(s) is/are relatively large in comparison to the high resolution monitor 162 or other game display device 178 of gaming machine 100. The bonus game display(s) 236 may be positioned in an area above the gaming machines $G_1, G_2 \ldots G_n$ so that the screen(s) is/are visible to all players at the bank 214 of gaming machines $G_1, G_2 \ldots G_n$. Bonus game display 236 may comprise other types of display screens known in the art including cathode ray tube (CRT) screens, plasma display screens, and/or screens based on light emitting diode (LED) technology. Bonus game display 236 may be a display screen configured for multiple uses and/or concurrent display of other casino-sponsored information. For example, bonus game display 236 may be used in association with a Sports Book venue of the casino during periods in which bonus game display 236 is temporarily not used for the purposes of the present invention.

Gaming machines $G_1, G_2 \ldots G_n$ may be connected to bonus game display 236 through communication link 234. Communication link 234 may be any of a variety of communication links known in the art, including, but not limited to: twisted-pair wire, coaxial cable, fiber optic, Ethernet, token ring, bus line, Fibre Channel, ATM, standard serial connections, LAN, WAN, Intranet, Internet, radio waves, or other wireless connections.

In the bonus game of the present invention, the player of the base game at one of gaming machines $G_1, G_2 \ldots G_n$ qualifies for the bonus game by achieving a specific outcome or by meeting other selected criteria associated with play of the base game. Since the gaming machines $G_1, G_2 \ldots G_n$ are linked, multiple players of the base game may qualify for the bonus game by achieving the specific outcome.

In order to qualify for the bonus game, a special symbol or element may be provided on one or more reels of the slot machine of the base game. These symbols are referred to as "event symbols." The player may be required to achieve a predetermined number of event symbols, referred to as the specific outcome, to participate in the bonus game. The type of event symbols provided on the reels may be related to the theme of the bonus game. For example, in a space exploration bonus game, the event symbol may be a space ship or alien. The number of event symbols necessary to activate the bonus game may vary, depending on how frequently the gaming establishment wants the bonus game activated. Other ways to qualify for the bonus game may also be contemplated. For instance, players may qualify by wagering certain amounts in the base game, by receiving a certain number of payouts in the base game, by achieving multiple specific outcomes in the base game, by playing the base game a preselected number of times, by playing the base game multiple times for a preselected duration of time, or by wagering a preselected sum over a plurality of plays of the base game.

Upon qualifying for the bonus game, the player is notified of his opportunity to participate by an interaction with his gaming machine 100, which is one of the bank 214 or other plurality of gaming machines $G_1, G_2 \ldots G_n$. This interaction may occur through the appearance of a message on touch screen 166. Once activated, the bonus game may start immediately. The player markers of players who subsequently qualify for the bonus game may be randomly positioned in the bonus game field as the players qualify. Depending on the number of players at the bank 214 of gaming machines, the bonus game may be in play continuously. For instance, during high-peak hours, new players may qualify for the bonus game as players already in the game choose to leave or are eliminated or exited from the game.

However, the bonus game may also start after a certain number of players have qualified for the bonus game, when the bonus pool reaches a predetermined level, at fixed or random time intervals (activate the bonus game one-half hour after the conclusion of the last bonus game or every hour on the half hour), randomly throughout the day, when a predetermined number of base games in the bank 214 has been played, or in response to a game outcome.

When the bonus game is ready to start, the players currently qualified to participate may be advised of their entry through the touch screen 166 and/or an audio signal, an audible countdown and the sound of a rocket ship blasting off, such as a trumpet blast, bells, music, etc. It is also contemplated that the qualified players may be queried through the touch screen 166 or other communication element associated with gaming machine 100 as to whether they wish to participate in the bonus game.

The bonus game field 430 (FIGS. 4–6) may be displayed on at least one of high resolution monitor 162, game display device 178, or bonus display device 236. If multiple players have qualified for the bonus game, the game may be displayed on bonus display device 236, in addition to being displayed on each player's gaming machine 100. Displaying the bonus game on bonus display device 236 may allow non-participating casino patrons to view the game and become involved in the excitement.

Figure 4:
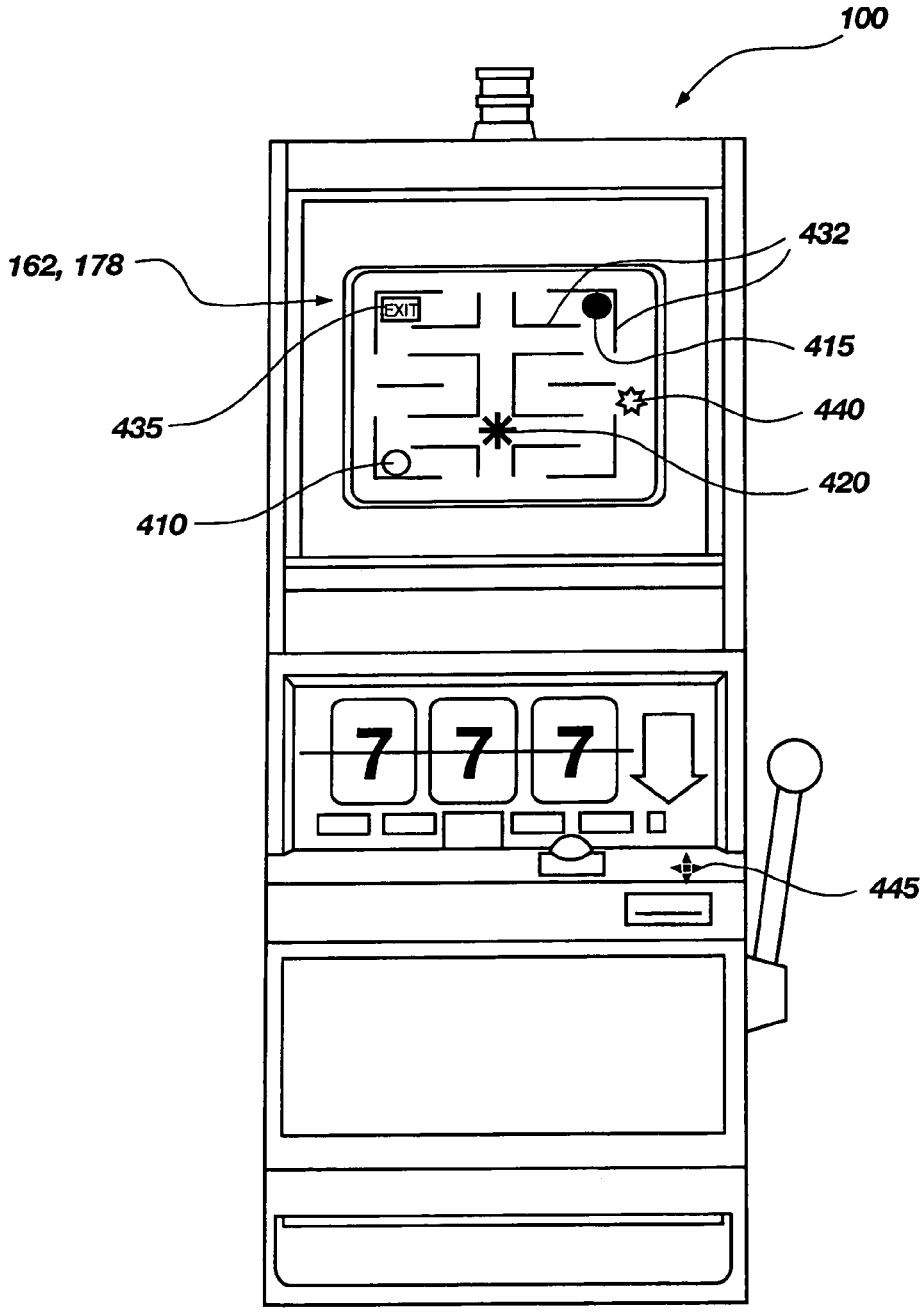
FIG. 4 illustrates an exemplary embodiment of the bonus game of the present invention.
Figure 5:
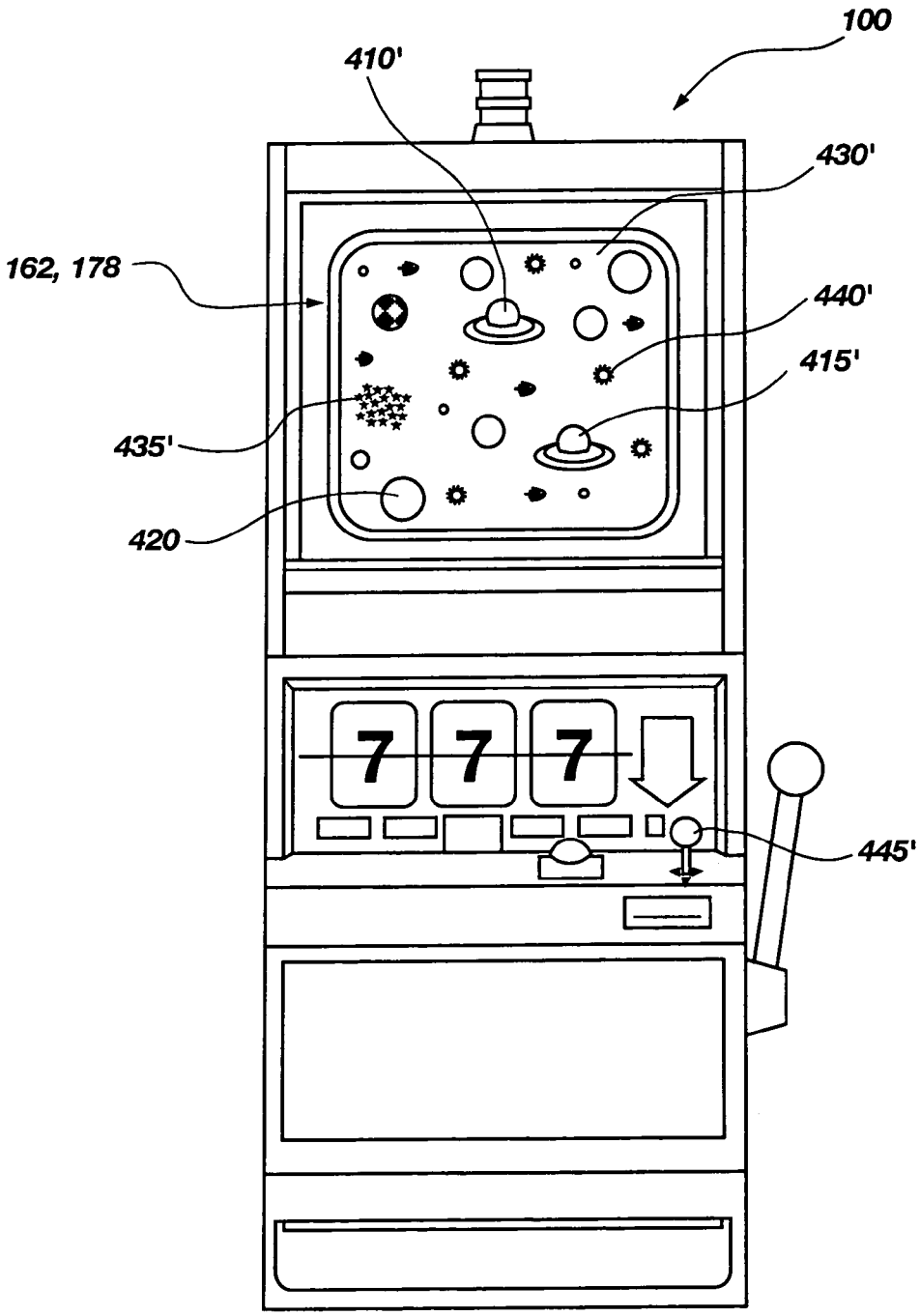
FIG. 5 illustrates another exemplary embodiment of the bonus game of the present invention.
Figure 6:
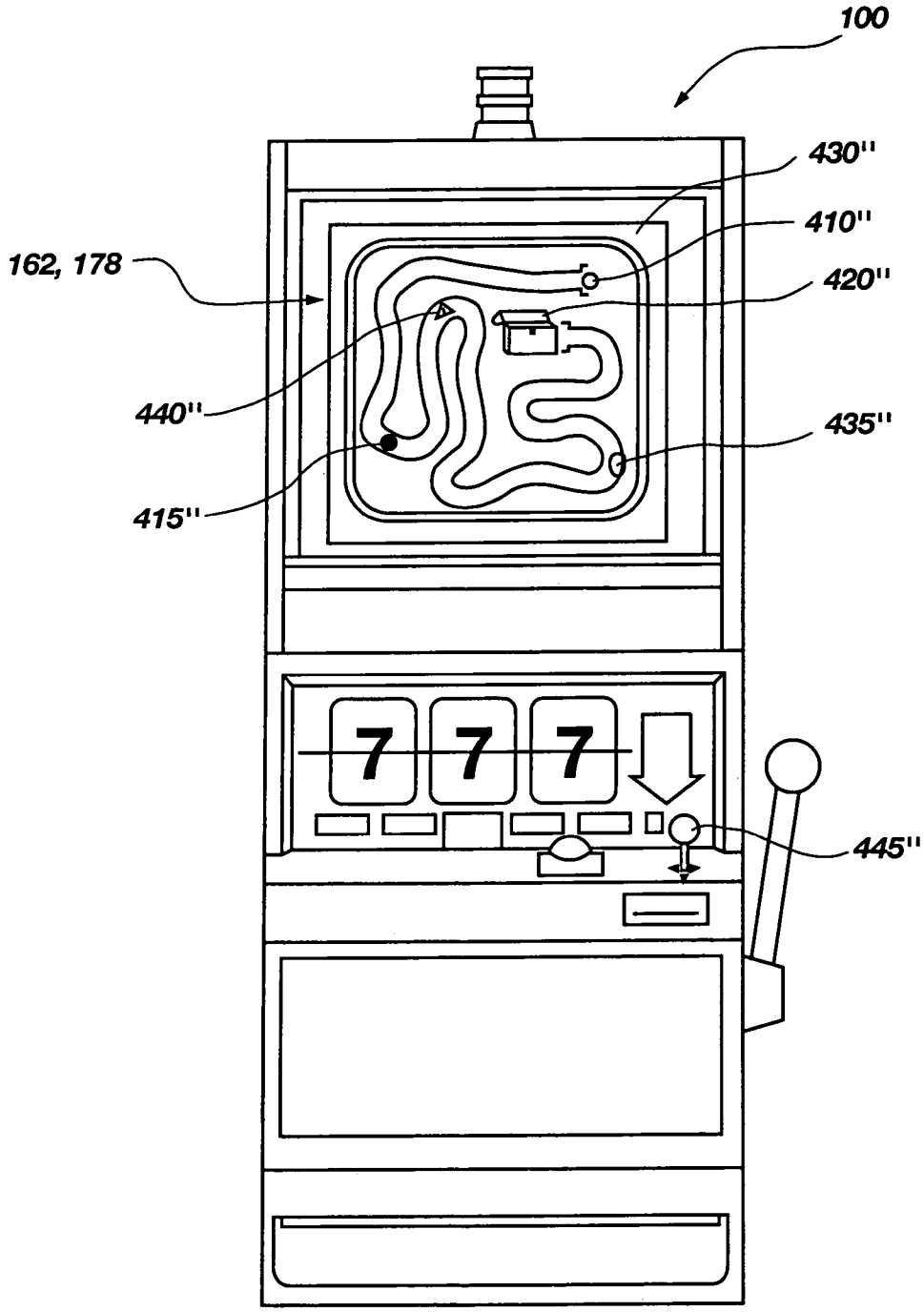
FIG. 6 illustrates yet another exemplary embodiment of the bonus game of the present invention.

As shown in FIGS. 4–6, the bonus game of the present invention may include a bonus game field 430 displayed on high resolution monitor 162 or game display device 178 of gaming machine 100. The bonus game field 430 may comprise an area or space, such as a series of pathways or scenes, through which the player navigates to accumulate bonus awards. The bonus game field is comprised of a series of gaming spaces upon which a player's markers may be moved in the course of play. The bonus game field 430 may be displayed in two or three dimensions and may further include player markers 410 and 415, bonus markers 420, exit markers 435, and hazard markers 440, as will be described in more detail below. The bonus game may be based on a theme wherein the visual display of the bonus game is consistent with the chosen theme. For example, the theme of the bonus game may include, but is not limited to, space travel or exploration, a safari trip, or an adventure trip.

The bonus game field 430 may be displayed as a maze that is comprised of an intricate network of passages. The player's movement through the maze may be blocked in certain directions by maze walls, obstacles, and hazards, depending on the player's location in the maze. The bonus game field 430 may also be displayed as an open area or space where the player's movement is blocked by obstacles or hazards.

The player's location in the bonus game is indicated by at least one player marker 410,415. Each player marker 410, 415 is associated with the gaming machine that triggered its existence and is selected to be consistent with the theme of the bonus game. For example, in a space exploration bonus game, the player markers 410,415 may be space ships or astronauts. Upon qualifying for the bonus game, the player marker 410,415 may be inserted in a random space of the bonus game field 430 or inserted at a predetermined starting location on game field 430. The player marker 410,415 may also be randomly inserted into a bonus game 410,415 already in progress. If multiple players are participating in the bonus game, each player marker is distinct so that each player may easily identify the player marker associated with his or her gaming machine 100, as well as the player markers 410,415 associated with the gaming machines of other players. Each player may also have multiple player markers 410,415 associated with his or her gaming machine, as will be described in more detail below.

The bonus game may also include multiple bonus markers 420 randomly located throughout the bonus game field 430 at various locations thereof. The bonus markers 420 may be visually indicated with bonus symbols or may be invisible to the players. If the bonus marker 420 is visible, it may be located in a predetermined position in the bonus game or it may be mobile. If the bonus marker 420 is mobile, the bonus marker 420 may constantly move around to different spaces of the bonus game field 430 or may randomly appear and disappear at different locations or spaces. If the bonus marker 420 is invisible, it may become visible once a player marker draws near to or occupies the same space as the bonus marker 420. The invisible bonus marker 420 may also become visible for brief periods of time, either randomly or at predetermined time intervals. The bonus symbol selected for the bonus marker 420 may indicate the nature or value of the bonus award associated with each bonus marker 420. However, if the bonus symbol is invisible or is not indicative of the bonus award, the amount of the bonus award may be revealed when the player marker 410,415 draws near to or occupies the same space as the bonus marker 420.

The bonus award associated with each bonus marker 420 may include a monetary award, a point or credit award, an award that terminates play of the bonus game, or an award that directs play of the bonus game. For example, the play directive award may direct the player to advance or retreat in the bonus game. The monetary and credit awards may be generated by adding or crediting a predetermined amount to the bonus award as each player qualifies for the bonus game by achieving the specific outcome in the base game. This predetermined amount may be a monetary award or a number of credits or points. The award may be a progressive jackpot generated by play of the base game. Progressive jackpots are preferably provided because they provide substantially higher potential awards, albeit with a lower probability of payout, which may be attractive to players of the bonus games. Since each bonus game may include multiple bonus awards, the predetermined amount may be added to one existing bonus award, equally divided between all existing bonus awards, or used to create a new bonus award. Alternatively, the bonus awards may comprise fixed monetary or credit amounts or may be established by the payout schedule of the base game.

As another example, the amount associated with each of the bonus awards may increase as the players continue to wager in the base game. The amount of the bonus award may be easily discerned by each player or may be hidden from the players, depending on the bonus symbol selected for the bonus marker 420. For example, if the bonus symbol is a number, the players will know that the bonus award is an amount equal to that number. However, if the bonus symbol is an arbitrary symbol, such as a treasure chest, the players will not know the amount of the bonus award. Alternatively, the total amount of the bonus awards may be displayed without displaying the amount of individual bonus awards.

A bonus award may be eliminated from the bonus game upon distribution thereof to a player. However, this eliminated bonus award may also be restored or regenerated and a corresponding bonus marker 420 randomly inserted onto the bonus game field 430 at a later time. For example, the bonus award may be regenerated depending on the number of players playing the base game. During off-hours, bonus awards may not be regenerated because the amount of play received by the gaming machines 100 is reduced. Conversely, during high-peak hours, multiple bonus awards may be regenerated, and new bonus awards created, to keep up with the amount of play on the gaming machines 100.

The bonus game may comprise only one bonus award. Depending on the number of players playing the base game, this may generate one large bonus award, with the entire amount to be awarded to one player. However, in this situation, each player would have reduced odds of winning the bonus award. Therefore, players may prefer to have multiple, smaller bonus awards that are easier to win. Accordingly, the bonus game may alternatively include such smaller bonus awards.

The bonus game may also comprise exit markers 435 that terminate the player's progress or movement through the bonus game. The exit marker 435 may be selected to be consistent with the theme of the bonus game, such as an asteroid field or black hole in a space exploration bonus game. If a player marker 410,415 is placed or lands on the exit marker 435, that player marker 410,415 may be removed from the bonus game field 430 and the corresponding player may be exited or removed from the bonus game and returned to the base game. The player may leave with any bonus awards that have already been distributed to him or her. This player is removed to the base game and may requalify for the bonus game by again achieving the specific outcome in the base game. The exit marker 435 may be visible or invisible to the players. If the exit marker 435 is invisible, the player may be completely surprised when his or her marker 410, 415 lands upon it or a space of the bonus game field 430 at which the exit marker 435 is located, which provides additional excitement in the bonus game. The exit markers 435 may also provide an optional way for players to terminate their participation in the bonus game. For example, the player may deliberately position his or her player marker 410,415 on the exit marker 435 if he or she does not want to continue playing the bonus game. In addition, the exit marker 435 may be necessary to terminate the bonus game in games where there is no direct competition between players.

In addition to exit markers 435, the bonus game may comprise hazard markers 440 that impede the player's movement or progress through the bonus game. Hazard markers 440 may be visible or invisible to the players and may penalize, or otherwise set back, the player. For example, the hazard marker 440 may relocate the player's player marker 410,415 to a less desirable location or space on the bonus game field 430, such as at a far distance from any bonus markers 420. The hazard marker 440 may also prevent a player from moving his or her player marker 410,415 and cause it to remain in its current position.

The qualified players participate in the bonus game by interacting with a direction control device 445 that allows each player to control the movement of his or her player marker 410,415. The player may navigate his or her player marker 410,415 through a bonus game field 430 in an attempt to achieve a particular bonus game outcome. The bonus game outcome may include occupying the same space as a bonus marker 420, hazard marker 440, or exit marker 435. Specifically, the player may navigate his or her player marker 410,415 through the bonus game field 430 in an attempt to accumulate bonus markers 420 and receive the associated bonus awards, while avoiding exit markers 435, hazard markers 440, and other qualified players' markers 410,415. The game may optionally be configured to enable a player's marker to "capture" another player's marker, as discussed further below. The player may navigate or steer his or her player marker 410,415 in the direction he or she chooses using the direction control device 445. The direction control device 445 may be a joystick, a plurality of buttons that indicate up/down/left/right, a track ball, a touch pad, or another device that controls the direction of movement in the bonus game. The direction control device 445 may also be provided with a null position that maintains the current position of the player marker despite continued play of the base game. The direction control device 445 is not limited to vertically and horizontally directed movement but may also allow for vector control, such as angular direction and distance. In a three-dimensional bonus game, the direction control device may provide a three-dimensional vector for movement of the player marker.

Since each player may control the movement of his or her player marker 410,415, the player is in control of the player marker's 410,415 direction of movement. The player may use skill or strategy to decide the direction in which to move in order to accumulate bonus awards while avoiding exit markers 435, hazard markers 440, and other qualified players' markers 410,415. The player may choose the direction based upon the amounts and locations of the bonus awards, the locations of other players' markers 410,415, and the locations of exit markers 435 and hazard markers 440. This degree of control may greatly appeal to many players.

Bonus awards are awarded to the gaming machine associated with the player marker 410,415 that occupies the same space as the bonus marker 420. When the player marker 410,415 occupies the same space as the bonus marker 420, the player may immediately receive the bonus award associated with that bonus marker 420. However, the player may be required to play the base game in order to receive the bonus award. For example, the player may be required to achieve a second specific outcome in the base game before receiving the bonus award. In other words, once the player marker 410,415 lands on the bonus marker 420, the bonus game may be temporarily paused or suspended. The player may be transferred back to the base game to achieve the second specific outcome. The second specific outcome may be the same specific outcome used to qualify the player for the bonus game or a separate specific outcome. The player marker 410,415 remains at its position on the bonus marker 420 until the second specific outcome is achieved. If the player achieves this second specific outcome, thereby winning the bonus award, he or she may be automatically exited from the bonus game or may continue play of the bonus game with the same player marker 410,415 and attempt to proceed to another bonus marker 420.

Since multiple players may simultaneously qualify to play the bonus game of the present invention, the degree of competition between the players may be dramatically increased by enabling the qualified players to eliminate each other from the bonus game. For instance, a first player may act offensively and eliminate a second player by occupying the same space as the second player. The eliminated second player is removed to the base game and may requalify for the bonus game by achieving the specific outcome in the base game. The second player's marker 410,415 may be eliminated or removed from any location on the bonus game field 430, including if his or her marker 410,415 is located on one of the bonus markers 420. If the second player is eliminated while his or her marker 410,415 is positioned on the bonus marker 420, the opportunity to receive the bonus award associated with that bonus marker 420 may be transferred from the second player to the first player. By eliminating players from the bonus game, the first player may reduce his or her chances of being eliminated by other players and increase his or her chances of accumulating bonus awards. Furthermore, since the player markers 410,415 are distinct, players may know who they are competing against and may take revenge against other players who may have eliminated them in a previous round of the bonus game.

Additional aspects of this competition feature are also contemplated as being within the scope of the present invention. For instance, a player may be provided with an additional award for each player that he or she eliminates from the bonus game. Further, if the bonus game is configured to enable a player's marker is used to "capture" another player's marker, such capture may entail a transfer of bonus points from the captured marker player to the capturing marker player. In addition, the first player may eliminate the second player by a confrontation between the players, such as an electronically simulated fight, a trivia contest, or some other random or competitive event.

The bonus game may also be configured to allow one player to participate. This feature may be required during off-peak hours when fewer players are present in the casino or when the bonus game is configured for a stand-alone gaming machine. The one player may—compete against the gaming machine 100 or may simultaneously control multiple player markers 410,415. If the player is competing against the gaming machine 100, the bonus game may be configured to produce machine-generated challenges that impede the player's progress through the bonus game field 430. These challenges may include configuring the bonus game to generate a threat that chases a player marker 410,415 while the player is trying to accumulate bonus awards. This version of the bonus game may also comprise exit markers 435 and hazard markers 440, as previously described.

In a one-player version of the bonus game where the player has control over multiple player markers 410,415, many aspects of the bonus game are as previously described. For example, specific outcomes in the base game may allow the player to move at least one of his player markers 410,415 by at least one space increment. In addition, the player may choose the direction in which to navigate one or more of his or her player markers 410,415 in order to accumulate the bonus awards. However, it is contemplated that if the bonus markers 420 are mobile, the player may navigate the player markers 410,415 so that each player marker 410,415 is attempting to capture a bonus marker 420 and, thus, accumulate a corresponding bonus award. In addition, the player may coordinate all or some of his or her player markers 410,415 to trap one bonus marker 420 between the player markers 410,415.

In one approach, play of the bonus game may be dependent on play in the base game or previous success in the bonus game. In this approach, the player's progress or movement in the bonus game field 430 may be directly linked to play of the base game by incrementally moving the player marker 410,415 as the base game is played. Since the base game and bonus game are played in conjunction with each other, awards are paid out both in the base game and in the bonus game. The base game awards are based on payout schedules typical of slot machines and progressive types of slot machines, as known in the art, while the bonus awards may only be earned if the player has qualified for the bonus game.

In this approach, the bonus game is played simultaneously and in conjunction with, the base game. For every play of the base game, such as a pull of the handle in the slot machine, the player marker 410,415 may be moved one space increment. The player marker 410,415 may be moved multiple space increments based on factors such as the amount of the wager and/or the speed of play in the base game, the amount of time spent in the bonus game, or the number of bonus awards won by the player. For instance, if the player wagers a quarter in the base game, the player may move his or her player marker 410,415 one space increment in the direction selected by the player. However, if the player wagers one dollar, the player may move four space increments. In addition, the speed at which the player marker 410,415 moves in the bonus game may be controlled by the speed of play in the base game. If the player is making rapid, successive wagers in the base game, the player marker may move quickly in the bonus game in comparison to its speed if the player had been making slow wagers. Players may want the increased speed in the bonus game because it will allow them to more quickly accumulate bonus awards, to more quickly eliminate other players from the bonus game, and to avoid other players' markers 410,415 in the bonus game. Furthermore, if the player has spent a long period of time in the bonus game or has won multiple bonus awards, the player marker 410,415 may be moved multiple space increments in the bonus game for additional play in the base game.

It is also contemplated that the player's movement in the bonus game may depend on the game outcome in each play of the base game. For example, certain outcomes in the base game may allow the player to move multiple increments while other outcomes may allow the player to advance directly to the bonus marker.

By linking the player's progress in the bonus game with his or her play of the base game or previous success in the bonus game, it is likely that the player will increase the amount and speed of his or her wagers in the base game, thereby increasing the productivity of the gaming machine he or she is playing.

While is it preferred that play of the bonus game is dependent on play in the base game, a second approach is contemplated where movement of the player marker may be independent of play in the base game. Once the player has qualified for the bonus game, his or her player marker 410,415 may be moved at a fixed speed regardless of the amount or speed of the wagers in the base game. Stated another way, the players do not gain any advantage by wagering higher amounts or increasing the speed of their wagers in the base game. In this approach, the base game is similar to a penalty box in a hockey game because it is primarily used to qualify the players for the bonus game and as a place for players to stay while waiting to requalify after being exited or eliminated from the bonus game.

In one currently preferred embodiment, the base game is a slot machine and the bonus game is a maze comprised of an intricate network of passages. As illustrated in FIG. 4, the player's movement through the maze may be blocked by maze walls 432, exit markers 435, and hazard markers 440, depending on the player's location in the maze on game field 430. Each qualified player is represented on the bonus game field with a distinct player marker 410,415. FIG. 4 shows two player markers: a first player marker 410 and a second player marker 415. However, it is understood by one of ordinary skill in the art that any number of player markers 410,415 may be displayed on the bonus game field 430, depending on the number of players who have qualified for the bonus game.

The player markers 410 and 415 are navigated around the bonus game field 430 using the direction control device 445. The speed of movement of the player markers 410 and 415 is controlled as previously described. Bonus markers 420 are displayed on the bonus game field 430 and are located in positions that can be reached by incremental movement of the player markers 410 and 415. The players navigate their player markers 410 or 415 around the maze of the bonus game field 430 to accumulate bonus awards associated with the bonus markers 420, which are depicted in FIG. 4 as stars. While the players are navigating their player markers 410 and 415 around the bonus game field 430, they must avoid exit marker 435, which is depicted as an exit sign. In addition, the player must avoid hazard marker 440, which is displayed in FIG. 4 in dashed form to indicate that it is hidden from the players' view.

In another currently preferred embodiment, the base game is a slot machine and the bonus game is a space exploration game. As shown in FIG. 5, first and second player markers 410' and 415' are depicted as space ships and are navigated around the bonus game field 430', using direction control device 445'. The player markers 410 and 415' must land on bonus marker 420', depicted as a planet, to receive the bonus award associated therewith. However, the player markers 410' and 415' must avoid the exit marker 435', depicted as an asteroid field, and the hazard marker 440', depicted as a sun.

In yet another preferred embodiment, the base game is a slot machine and the bonus game is a treasure hunt. The bonus game field 430" is displayed as an island. As shown in FIG. 6, the first and second player markers 410" and 415" are positioned on the island and are navigated using direction control device 445". The player markers 410" and 415" must land on bonus marker 420", depicted as a treasure chest, to receive the bonus award associated therewith. However, the player markers 410" and 415" must avoid the hazard marker 440", depicted as a warning triangle, and exit marker 435", depicted as a lake.

It is understood by one of ordinary skill in the art that the symbols used to depict the player markers 410 and 415, bonus markers 420, hazard markers 440, and exit markers 435 and their equivalents as indicated by prime and double prime superscripts in these embodiments of the bonus game may be changed without departing from the scope of the invention. For example, player markers 410 and 415 may be depicted as people or cars; exit marker 435' may be depicted as a black hole; or hazard marker 440" may be depicted as a crocodile or a skull-and-crossbones.

While the exemplary embodiments disclose using at least one gaming machine G located at one casino site, it is possible for remote players of the base game to qualify for the bonus game of the present invention using the gaming system 310 previously described. For instance, these remote players may play the base game on networked gaming machines at mutually remote sites within a casino, at a plurality of mutually remote casino sites, or at virtual gaming sites such as personal computers or other device serving as terminals. As is known in the art, software to play the base game may be downloaded onto a personal computer and the base game played over the Internet.

Upon qualifying for the bonus game, which may occur in a manner similar to qualification on a gaming machine G located at the casino site, the player may be provided with an opportunity to wager on the bonus game. It is contemplated that the software downloaded to the personal computer may include the bonus game of the present invention or sufficient communication capability to interact in real time with a remote host server. The existence and further development of broadband communication links including DSL, cable, and even broadband wireless may enable remote play from a variety of locations using diverse hardware such as hand-held wireless terminals at a casino, personal digital assistants (PDAs), etc. Further, the bonus game may be posted on an Internet site associated with the casino or other sponsor of the bonus game. The bonus game is accessible to the player if the specific outcomes are achieved in the base game. The player may participate in the bonus game through his personal computer terminal via the Internet, such as through streaming audio or video.

Figure 3:
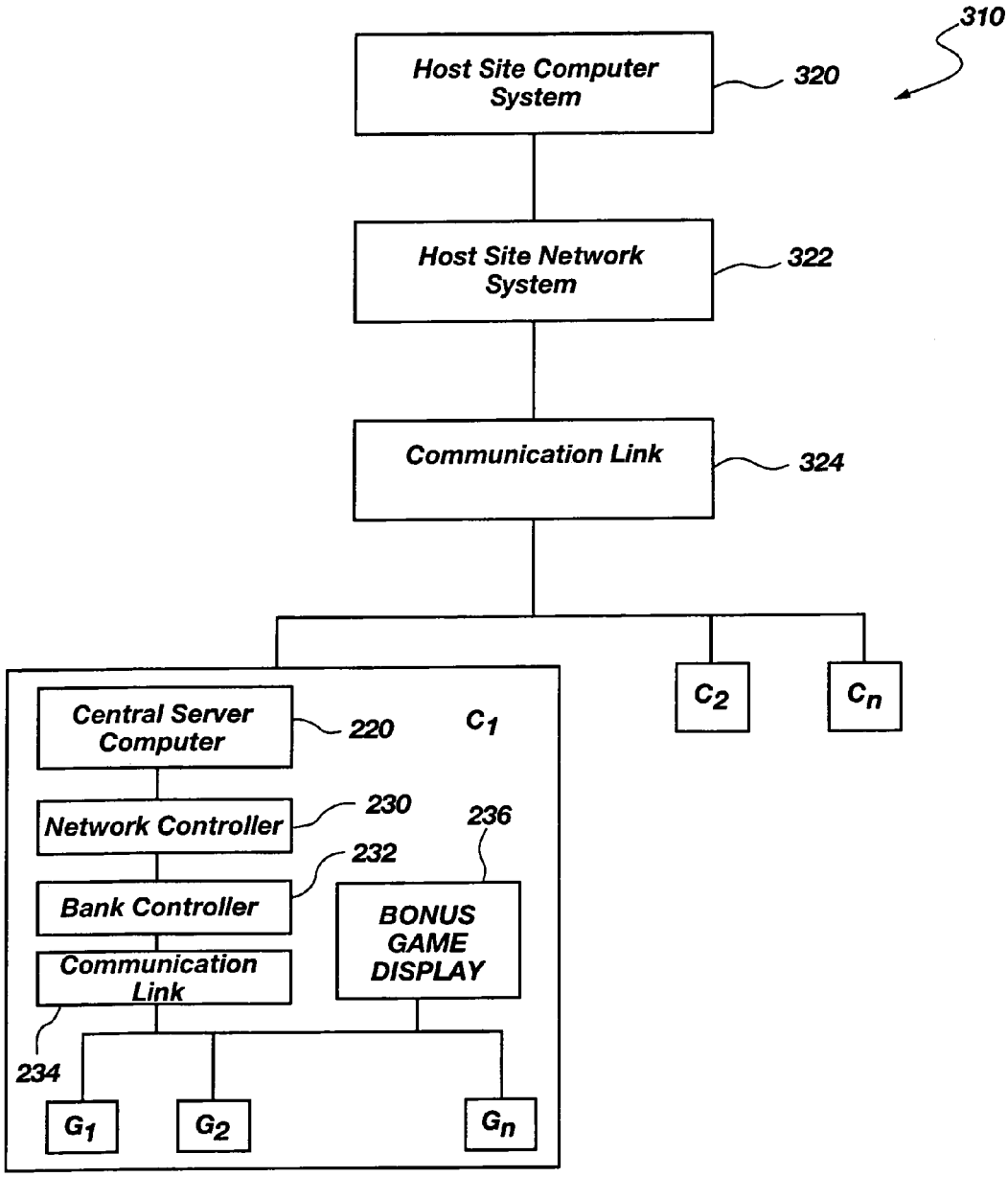
FIG. 3 illustrates an exemplary competitive bonus game system according to the present invention.

As shown in FIG. 3, and previously described, system 310 includes a host site computer 320 operably coupled to multiple central server computers 220, which may be located at a variety of remote casino or other gaming sites. Alternatively, central server computers 220 may be used to interface with a plurality of personal computers, PDAs, or other terminals. Preferably, the host site computer 320 will be maintained for the overall operation and control of the competitive bonus gaming system 310. Each physical or virtual gaming site, represented as $C_1$, $C_2$ . . . $C_n$ in FIG. 3, includes the network controller 230, the bank controller 232, and the communications link 234 interposed between each central server computer 220 and the multiple gaming machines schematically illustrated as $G_1$, $G_2$ . . . $G_n$. As alluded to above, gaming machines $G_1$, $G_2$ . . . $G_n$ may comprise conventional gaming machines 100, personal computers, wired or wireless terminals, PDAs, or a combination thereof. Thus, the term "gaming machine" is used herein in its broadest sense and encompasses any device used as a terminal by at least one player to participate in the bonus game.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method comprising:

providing each of a plurality of players with at least one opportunity to qualify for play of a bonus game during play of a base game of chance, each player competing in the bonus game against other players by navigating a player marker on a bonus game field; and playing the bonus game to a bonus game outcome, wherein the bonus game outcome is determined at least partially by skill or strategy of at least one qualified player of the plurality, wherein playing the bonus game to a bonus game outcome comprises positioning the player marker in the same space of the bonus game field as one of a bonus marker, a hazard marker, or an exit marker.

2. The method of claim 1, wherein at least one of the bonus marker, the hazard marker, and the exit marker is at least sometimes invisible in the bonus game.

3. The method of claim 1, wherein providing each of the plurality of players with at least one opportunity to qualify for play of the bonus game comprises at least one of the following events associated with play of the base game:

achieving at least one specific outcome during play of the base game;

achieving an accumulation of specific outcomes during play of the base game;

playing the base game a specific number of times;

playing the base game a plurality of times for a specific duration of time; and wagering a specific sum over a plurality of plays of the base game.

4. The method of claim 1, wherein providing each of the plurality of players with at least one opportunity to qualify for play of the bonus game comprises providing each of the plurality of players with at least one opportunity to achieve a specific outcome during play of the base game.

5. The method claim 1, further comprising providing each of the plurality of players with an opportunity to eliminate at least one other player of the plurality of players from the bonus game.

6. The method of claim 5, wherein providing each of the plurality of players with the opportunity to eliminate at least one other player of the plurality of players from the bonus game comprises enabling a first player of the plurality to position their player marker on the same space of the bonus game field as that space on which a player marker of a second player of the plurality of players is located.

7. The method of claim 5, wherein, upon being eliminated from the bonus game, the at least one other player is transferred to the base game.

8. The method of claim 7, wherein the at least one other player is provided with an opportunity to requalify for the bonus game by achieving at least one specific outcome during play of the base game.

9. The method of claim 1, wherein the bonus game field comprises a maze or an open space through which each player marker may be moved.

10. The method of claim 1, wherein the bonus game is electronically implemented.

11. The method of claim 1, wherein the bonus game is physically implemented.

12. The method of claim 1, wherein positioning the player marker in the same space as the bonus marker results in a player receiving a bonus award associated with the bonus marker.

13. The method of claim 12, further comprising:

the bonus award distributing to the player after the player achieves a second specified outcome in the base game.

14. The method of claim 12, wherein the bonus award is selected from the group consisting of a monetary award, a credit award, a play directive award, and a game termination award.

15. The method of claim 14, wherein the monetary award comprises at least a portion of a progressive jackpot.

16. The method of claim 13, further comprising exiting the player from the bonus game after distributing the bonus award.

17. The method of claim 13, further comprising permitting the player to attempt to accumulate one or more additional bonus awards after distributing the bonus award.

18. The method of claim 1, wherein positioning the player marker in the same space as the hazard marker at least temporarily impedes a player's movement in the bonus game.

19. The method of claim 1, wherein positioning the player marker in the same space as the exit marker removes the player marker from the bonus game field and terminates a player's play of the bonus game.

20. The method of claim 1, wherein navigating the player marker on the bonus game field is associated with play of the base game.

21. The method of claim 20, wherein the player marker is moved at least one space increment on the bonus game field for each base game play.

22. The method of claim 20, wherein the player marker is moved a plurality of space increments on the bonus game field for each base game play.

23. The method of claim 22, wherein the player marker is moved a plurality of space increments on the bonus game field, the number of space increments correlating with the amount of a wager or speed of play in the base game.

24. The method of claim 1, wherein each of the plurality of players plays the base game and has the opportunity to qualify for the bonus game at a respective plurality of gaming machines.

25. The method of claim 24, wherein play of at least the bonus game by the plurality of players is enabled by networking the respective plurality of gaming machines.

26. The method of claim 25, wherein qualification for enabling play of the bonus game is effected on a networked plurality of gaming machines.

27. The method of claim 24, wherein play of the base game by each of the plurality of players is also effected at the respective plurality of gaming machines.

28. The method of claim 24, wherein play of at least the bonus game by each of the plurality of players is effected at a plurality of mutually remote sites through a communication link.

29. A system comprising:

a plurality of gaming machines, each configured for play of a base game by a plurality of players and networked for play of a bonus game, wherein each player has an opportunity to qualify to compete in the bonus game against other players by navigating a player marker on a bonus field, the bonus game being configured to achieve a bonus game outcome determined at least partially by skill or strategy of at least one qualified player and the bonus game outcome comprising occupying the same space as one of a bonus marker, a hazard marker, or an exit marker; and apparatus networked to each of the plurality of gaming machines and configured with the bonus game for play by the plurality of players.

30. The system of claim 29, wherein each gaming machine of the plurality of gaming machines is configured to provide a player with an opportunity to enter the bonus game in association with play of the base game with which that gaming machine is configured.

31. The system of claim 30, wherein each gaming machine of the plurality of gaming machines is configured to provide a player with the opportunity to enter the bonus game upon occurrence of at least one of the following events associated with play of the base game with which that gaming machine is configured:

achieving at least one specific outcome during play of the base game;

achieving an accumulation of specific outcomes during play of the base game;

playing the base game a specific number of times;

playing the base game a plurality of times for a specific duration of time; and wagering a specific sum over a plurality of plays of the base game.

32. The system of claim 29, wherein the bonus game field comprises a maze or an open space.

33. The system of claim 29, wherein the bonus game is configured to distribute a bonus award associated with the bonus marker when the at least one qualified player occupies the same space as the bonus marker.

34. The system of claim 33, wherein the bonus game is further configured to distribute the bonus award after the at least one qualified player achieves a second specific outcome in the base game.

35. The system of claim 33, wherein the bonus game is further configured to exit the at least one qualified player from the bonus game after the bonus award is distributed.

36. The system of claim 33, wherein the bonus game is further configured to enable the at least one qualified player to accumulate additional bonus awards after the bonus award is distributed.

37. The system of claim 29, wherein the bonus game is further configured to impede movement in the bonus game when the at least one qualified player occupies the same space as the hazard marker.

38. The system of claim 29, wherein the bonus game is further configured to terminate movement in the bonus game when the at least one qualified player occupies the same space as the exit marker.

39. The system of claim 29, wherein the bonus game is further configured to permit a player to navigate a corresponding player marker through the bonus game field, wherein movement of the player marker depends on play of the base game.

40. The system of claim 39, wherein the bonus game is further configured to permit the player to move the corresponding player marker one space increment in the bonus game for each base game play.

41. The system of claim 39, wherein the bonus game is further configured to permit the player to move the corresponding player marker multiple space increments in the bonus game for each base game play.

42. The system of claim 41, wherein the bonus game is further configured to permit the player to move the corresponding player marker multiple space increments in the bonus game based upon the amount of wager or speed of play in the base game.

43. The system of claim 29, wherein the bonus game is further configured to eliminate at least one player of the plurality of players from the bonus game by enabling a marker of a first player of the plurality of players to occupy the same space as a marker of a second player of the plurality of players.

44. The system of claim 43, wherein the bonus game is further configured to eliminate the second player of the plurality of players and transfer the second player of the plurality of players to the base game.

45. The method of claim 43, wherein the bonus game is further configured to permit the second player of the plurality of players to requalify for the bonus game by achieving the at least one specific outcome during play of the base game.

46. The system of claim 29, wherein each of the gaming machines is further configured to enable each play of the base game responsive to a wager placed by a player.

47. The system of claim 29, wherein the apparatus further includes structure to implement the bonus game as a physical embodiment of the maze or the open space.

48. The system of claim 32, wherein the apparatus further includes structure to implement the bonus game as an electronic embodiment of the maze or the open space.

49. The system of claim 32, wherein at least some of the gaming machines of the plurality are configured as a bank of gaming machines at a single location.

50. The system of claim 29, wherein at least some of the gaming machines of the plurality are located at a plurality of mutually remote sites.

51. The system of claim 50, wherein at least some of the mutually remote sites comprise sites other than casinos.

52. The system of claim 29, wherein at least some of the gaming machines of the plurality comprise personal computers, PDAs, or wireless terminals.

53. The system of claim 29, wherein the apparatus comprises a bonus event computer programmed to implement the bonus game.

* * * * *